United States Patent [19]

Cameron-Johnson et al.

[11] 4,356,761

[45] Nov. 2, 1982

[54] FLUID PRESSURE MACHINES

[75] Inventors: Alan Cameron-Johnson, Bracebridge Heath; Michael J. Miles, Spilsby, both of England

[73] Assignee: Sauer United Kingdom Limited, London, England

[21] Appl. No.: 224,523

[22] PCT Filed: Mar. 31, 1980

[86] PCT No.: PCT/GB80/00058

§ 371 Date: Nov. 21, 1980

§ 102(e) Date: Nov. 21, 1980

[87] PCT Pub. No.: WO80/02175

PCT Pub. Date: Oct. 16, 1980

[30] Foreign Application Priority Data

Mar. 31, 1979 [GB] United Kingdom ..... 7911369

[51] Int. Cl.[3] ..... F01B 13/06

[52] U.S. Cl. ..... 91/490; 91/491; 91/492; 91/488

[58] Field of Search ..... 91/490, 491, 492, 497, 91/180; 417/273

[56] References Cited

U.S. PATENT DOCUMENTS

| | | | |
|---|---|---|---|
| 879,512 | 2/1908 | Braunwalder | 91/490 |
| 883,430 | 3/1908 | Smith et al. | 91/180 |
| 3,296,937 | 1/1967 | Guinet | 91/498 |
| 4,318,336 | 3/1982 | Bock | 91/490 |

FOREIGN PATENT DOCUMENTS

| | | | |
|---|---|---|---|
| 1261761 | 2/1968 | Fed. Rep. of Germany | 91/490 |
| 1528489 | 11/1970 | Fed. Rep. of Germany | 91/491 |
| 2252019 | 3/1975 | France | 91/180 |
| 1399596 | 2/1975 | United Kingdom | 91/491 |

*Primary Examiner*—William L. Freeh

*Attorney, Agent, or Firm*—Cushman, Darby & Cushman

[57] ABSTRACT

A fluid pressure machine such as a motor or pump has an orbiting cylinder block (9) housing a number of radial pistons (11) sliding within respective cylinders (10). Each piston has a cylindrical coaxial bore in which a fluid displacing member (13) fixed to the cylinder block is located so as to define within the cylinder an annular outer chamber (14) and an inner chamber (15). A selectively operable spool valve (36) is arranged for supplying hydraulic fluid under pressure to the inner and/or the outer chamber and thereby control the operating speed of the machine.

6 Claims, 3 Drawing Figures

FLUID PRESSURE MACHINES

Figure 1:
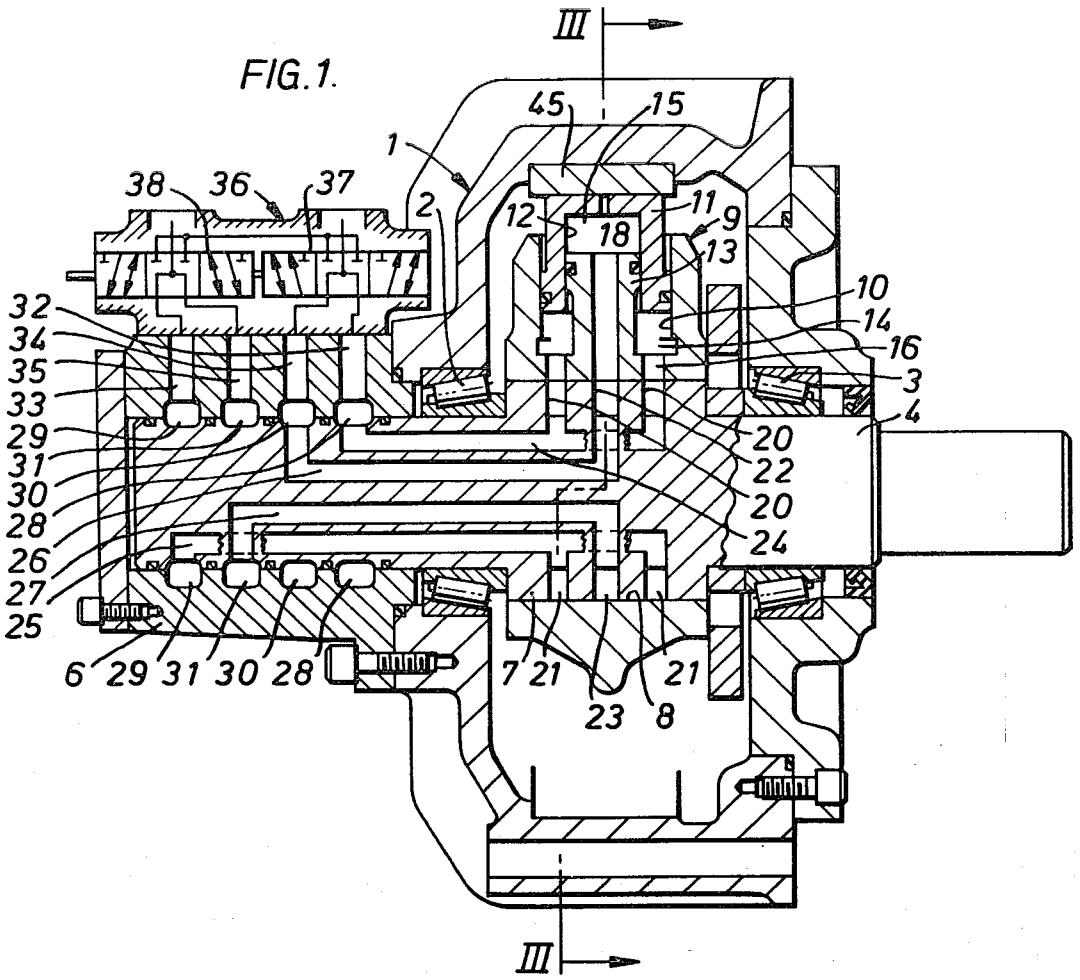

This invention relates to fluid pressure machines, specifically pumps and motors of the type having a number of cylinders arranged radially in a cylinder block which is mounted for orbital non-rotational movement within a housing. In such machines each cylinder contains a sliding piston which makes sliding contact with an abutment face within the housing. The cylinder block is supported on an eccentric journal carried by a rotatable shaft which is provided with internal ducts for conducting working fluid to and from each cylinder in sequence. In use of such a machine as a motor the successive pressurisation of each cylinder results in orbital motion of the cylinder block, which in turn produces rotation of the shaft, while in use of such a machine as a pump, the rotation of the shaft causes orbital motion of the cylinder block which results in a delivery of fluid under pressure from the cylinders sequentially in each rotation of the shaft.

In known fluid pressure machines of the aforesaid type various means have been proposed to vary the effective swept volume in each cylinder, and hence the relationship between the speed of rotation of the shaft and the fluid flow throughput of the machine, and the relationship between the pressure of the fluid and the torque in the shaft. One such means for varying the effective swept volume of each cylinder is to provide two coaxial pistons in each cylinder, one piston being slidable within the other so that the two pistons define separate working chambers within each respective cylinder. By selectively restraining the outer piston relative to the inner piston the total working volume within each cylinder can be varied, but in general such an arrangement is capable of only two different speeds or torques, namely that resulting from the operation of both pistons in tandem and that resulting from operation of the inner piston only.

An object of the present invention is to provide a fluid pressure machine of essentially simple construction which is capable of providing three alternative working speeds or torques selectively.

A fluid pressure machine according to the invention comprises a number of cylinders arranged radially in a cylinder block which is mounted for orbital nonrotational movement within a housing, pistons which are slidable within the cylinders and in sliding contact with abutment faces within the housing, and a rotatable shaft having an eccentric upon which the cylinder block is journalled, wherein each piston has a cylindrical axial bore, open at its radially inner end, in which a fluid displacing member, fixed relative to the cylinder block, is located, so that the piston defines within the cylinder an annular outer chamber between the cylinder wall and the displacing member, and an inner chamber within the piston bore and including selectively operable valve means for supplying fluid under pressure to the inner and/or the outer chamber to control the operating speed or torque of the machine.

The machine of the present invention is capable of three different working speeds or torques, selectable by operation of the valve means, corresponding respectively to three working conditions in which fluid pressure is supplied to (a) both the inner and outer chambers of each cylinder, (b) the inner chamber only of each cylinder and (c) the outer chamber only of each cylinder. Under all operating conditions the pistons remain in sliding contact with the abutment faces of the housing. Conveniently, therefore, advantage may be taken of hydrostatic balancing of the pistons by providing recesses in the surfaces of the pistons which contact the abutment faces, these recesses being supplied with fluid under pressure through ducts communicating with the inner and/or the outer chamber of the associated cylinder.

Preferably each fluid displacing member is coaxial with the associated cylinder and has a bore, coaxial with the cylinder, which communicates at its radially outer end with the bore of the respective piston and which opens at its radially inner end into a cylindrical axial bore in the cylinder block in which the eccentric is slidably located, the eccentric having two circumferentially spaced apart ports which are brought successively into communication with the bore of the displacing member upon rotation of the eccentric relative to the cylinder block. Furthermore, the cylinder block preferably has, for each cylinder, at least one radial passage communicating with the respective outer chamber and with the cylindrical axial bore of the cylinder block, the eccentric having two circumferentially spaced apart ports which are brought successively into communication with the outer chambers through the respective radial passages upon rotation of the eccentric relative to the cylinder block. The ports in the eccentric may communicate through respective longitudinally extending ducts in the shaft with respective annular grooves in the shaft and/or the housing which in turn communicate with respective ports of the valve means.

Figure 2:
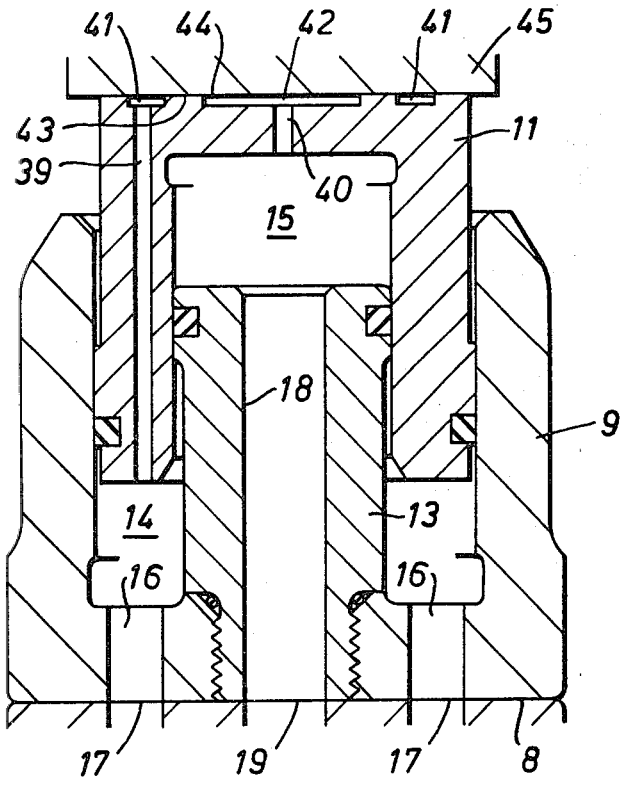
Figure 3:
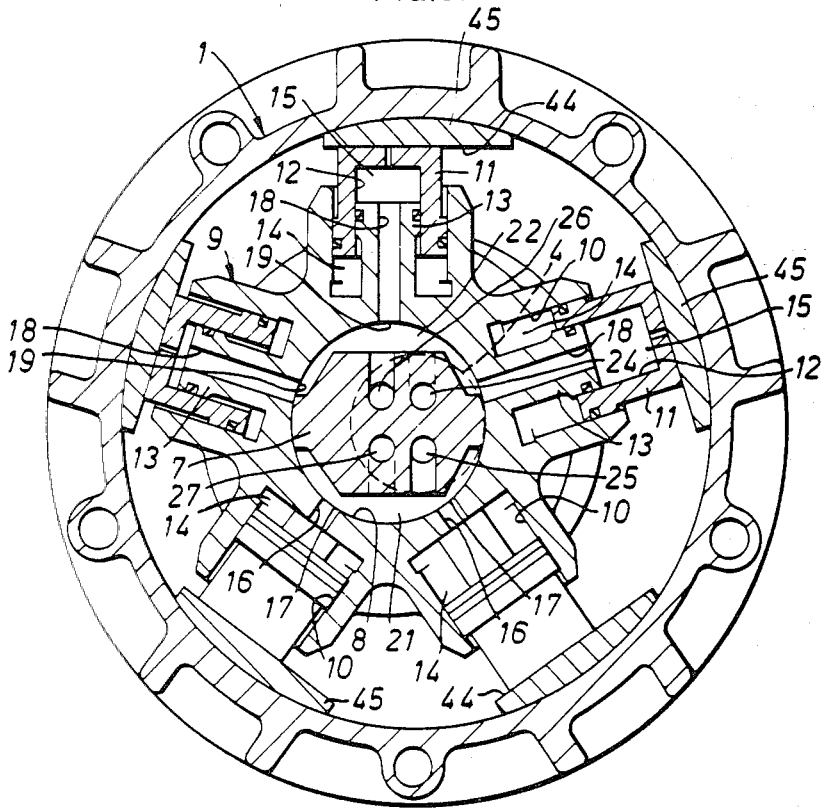

An embodiment of the invention will now be described, by way of example only, with reference to the accompanying diagrammatic drawings, in which:

FIG. 1 is an axial cross section through a fluid pressure machine according to the invention, FIG. 2 is an axial section, on an enlarged scale, of one of the cylinders of the machine shown in FIG. 1 and its associated piston, and FIG. 3 is a cross section taken on line III—III in FIG. 1.

The illustrated machine may be used as an hydraulic motor or pump and comprises a housing 1 having coaxial roller bearings 2, 3 in opposite end walls in which a shaft 4 is rotatably supported. The shaft 4 has an integral extension 5 which rotates within a cylindrical bore of a tubular housing extension 6 which is bolted to the housing 1.

The shaft 4 is formed with an integral eccentric 7 which has a cylindrical surface journalled within a cylindrical axial bore 8 formed in a cylinder block 9.

The cylinder block 9 is formed with a number of radial cylinders having cylindrical bores 10 within which respective pistons 11 are fluid-tightly slidable. Each piston 11 is cup-shaped with a cylindrical bore 12, open at its radially inner end, coaxial with the cylinder bore 10, and sliding fluid-tightly upon a fixed displacing member 13 housed coaxially within the respective cylinder and fixed to the cylinder block 9 being preferably formed integrally with the latter.

Each cup-shaped piston 11 defines within the associated cylinder an annular outer chamber 14 between the cylinder wall 10 and the displacing member 13, and an inner chamber 15 within the bore 12 of the piston 11.

The cylinder block 9 has, for each cylinder, at least one radial passage 16 (two are shown in the illustrated embodiment) communicating with the respective annular outer chamber 14 and with a respective port 17 in the surface of the cylindrical axial bore 8 of the cylinder block 9. Similarly, the fluid displacing member 13 within each cylinder has a bore 18, coaxial with the cylinder, which communicates at its radially outer end with the inner chamber 15 of the respective cylinder and at its radially inner end with a port 19 in the cylindrical axial bore 8 of the cylinder block 9.

The eccentric 7 on the shaft 7 is provided with two circumferentially spaced apart ports 20, 21 which communicate successively with each port 17 upon rotation of the shaft 4, and with two further circumferentially spaced apart ports 22, 23 which communicate successively with each respective port 19 upon rotation of the shaft 4. The ports 20, 21, 22 and 23 communicate through respective ducts 24, 25, 26, 27 which extend axially within the shaft 4 and which in turn lead to respective annular grooves 28, 29, 30, 31 spaced apart axially in the shaft extension 5 and communication with corresponding annular grooves in the housing extension 6. The annular grooves 28, 29, 30, 31 communicate through respective radial passages 32, 33, 34, 35 with respective ports of a control valve housing 36. The control valve has two coaxial three-position valve spools 37, 38 which respectively control the connection of fluid pressure supply and exhaust ports 37A, 38A with the respective pairs of passages 32, 34 and 33, 35 respectively. In the central position of the two spool valves 37, 38 illustrated in FIG. 1, fluid under pressure is supplied from port 37A to both the outer and inner chambers 14, 15 of each cylinder 9 in turn upon rotation of the shaft 4 through the respective ports 20, 22, fluid being exhausted from the chambers through the respective ports 21, 23 and the exhaust port 38A. In this mode of operation the machine operates with maximum fluid displacement in each cylinder, corresponding to maximum torque in the case of operation of the machine as a motor, and maximum fluid delivery when the machine operates as a pump.

In the end position of each spool 37, 38 shown on the left diagrammatically in FIG. 1 fluid under pressure is supplied to the outer chambers 14 of the respective cylinders only, while in the opposite end positions of the spool valves 37, 38 shown on the right diagrammatically in FIG. 1 fluid under pressure is supplied to the inner chambers 14 only of each cylinder. In both these positions of the spool valves 37, 38 the fluid displacement in each cylinder will be different, and will be less than the maximum fluid displacement resulting from the supply of fluid under pressure to both chambers of each cylinder. The fluid displaced in the unused chambers of the respective cylinders in the two end positions of the spool valves 37, 38, that is, the chambers which are not supplied with fluid under pressure from the external source, is transferred through the spool valve housing 36, to the corresponding chambers in opposed cylinders of the cylinder block, with only small fluid pressure losses.

In a variant of the illustrated machine, two-position rather than three-position spool valves may be provided for the selective supply of fluid under pressure to either the inner chamber (15) of each cylinder, or to both chambers 14, 15 in parallel, without the option of separate application of fluid under pressure to the outer chamber (14) affording in this case two different speeds of operation (in the case of a motor) or two different volumetric deliveries (in the case of a pump).

As illustrated in FIG. 2, respective passages 39, 40 may be provided in each piston 11, communicating respectively with the outer and inner chambers 14, 15 for the purpose of supplying fluid under pressure to respective recesses 41, 42 in the outer bearing face 43 of the piston 11, which makes sliding contact with a respective flat abutment face 44 of a pressure pad 45 fixed within the housing 1. In this way a hydrostatic bearing is formed at the interface between each piston 11 and the pressure pad 45, reducing frictional losses to a minimum.

The supply of hydraulic fluid under pressure to the ports 20 and/or 22, and the exhaustion of fluid through the ports 21 and/or 23 causes each piston 11 in turn to be forced radially outwardly against the respective pressure pad 45, reacting against the eccentric 7 and causing rotation of the shaft 4. This rotation in turn causes orbital non-rotational movement of the cylinder block 9 about the axis of the shaft 4.

We claim:

1. A fluid pressure machine comprising a number of cylinders (10) arranged radially in a cylinder block (9) which is mounted for orbital non-rotational movement within a housing (1), pistons (11) which are slidable within the cylinders and in sliding contact with abutment faces (44) within the housing, and a rotatable shaft (4) having an eccentric (7) upon which the cylinder block (9) is journalled, characterised in that each piston (11) has a cylindrical axial bore (12), open at its radially inner end, in which a fluid displacing member (13), fixed relative to the cylinder block (9), is located, so that the piston (11) defines within the cylinder (10) an annular outer chamber (14) between the cylinder wall and the displacing member (13), and an inner chamber (15) within the piston bore, and in that selectively operable valve means (36) are provided for supplying fluid under pressure to the inner and/or the outer chamber to control the operating speed or torque of the machine.

2. A fluid pressure machine as claimed in claim 1, characterised in that each fluid displacing member (13) is coaxial with the associated cylinder and has a bore (18), coaxial with the cylinder, which communicates at its radially outer end with the bore (12) of the respective piston (11) and which opens at its radially inner end into a cylindrical axial bore (8) in the cylinder block (9) in which the eccentric (7) is slidably located, the eccentric (7) having two circumferentially spaced apart ports (22, 23) which are brought successively into communication with the bore (18) of the displacing member upon rotation of the eccentric (7) relative to the cylinder block (9).

3. A fluid pressure machine as claimed in claim 2, characterised in that the cylinder block (9) has, for each cylinder, at least one radial passage (16) communicating with the respective outer chamber (14) and with the cylindrical axial bore (8) of the cylinder block (9), the eccentric (7) having two circumferentially spaced apart ports (20, 21) which are brought successively into communication with the outer chambers (14) through the respective radial passages (16) upon rotation of the eccentric (7) relative to the cylinder block (9).

4. A fluid pressure machine as claimed in claim 3, characterised in that the ports (20, 21, 22, 23) in the eccentric (7) communicate through respective longitudinally extending ducts (24, 25, 26, 27) in the shaft (4) with respective annular grooves (28, 29, 30, 31) in the shaft and/or the housing which in turn communicate with respective ports of the valve means (36).

5. A fluid pressure machine as claimed in any one of claims 1 to 4, characterised in that the valve means (36) has two operative positions in one of which fluid under pressure is supplied to the inner chambers (15) of the cylinders and in the other of which fluid under pressure is supplied to both the inner and outer chambers (14, 15) of the cylinders.

6. A fluid pressure machine as claimed in any one of claims 1 to 4, characterised in that the valve means (36) has three operative positions in which fluid under pressure is supplied respectively to the inner chambers (15) only, the outer chambers (14) only, and both the outer and inner chambers (14, 15) of the cylinders.

* * * * *